US005228650A

United States Patent [19]

Brönnimann

[11] Patent Number: 5,228,650

[45] Date of Patent: Jul. 20, 1993

[54] PRESTRESSING APPARATUS

[75] Inventor: Thomas Brönnimann, Liebefeld, Switzerland

[73] Assignee: Bieri Hydraulik AG, Liebefeld, Switzerland

[21] Appl. No.: 729,536

[22] Filed: Jul. 15, 1991

[30] Foreign Application Priority Data

Jul. 13, 1990 [CH] Switzerland ..... 2345/90

[51] Int. Cl.[5] ..... E21B 19/00

[52] U.S. Cl. ..... 254/29 A; 29/252; 254/93 R

[58] Field of Search ..... 29/252, 452; 254/29 A, 254/93 R

[56] References Cited

U.S. PATENT DOCUMENTS

| | | | |
|---|---|---|---|
| 2,075,239 | 3/1937 | Strange | 254/29 A |
| 2,101,141 | 12/1937 | Hungerford | 254/29 A |
| 2,696,040 | 12/1954 | Crom et al. | 29/452 |
| 2,866,370 | 12/1958 | Brach | 254/29 A |
| 3,285,569 | 11/1966 | Marr et al. | 254/29 |
| 3,785,617 | 1/1974 | Friedrich | 254/29 A |
| 4,559,691 | 12/1985 | Mannhart et al. | 29/252 |

FOREIGN PATENT DOCUMENTS

| | | |
|---|---|---|
| 1659109 | 12/1970 | Fed. Rep. of Germany . |
| 881191 | 11/1961 | United Kingdom . |

*Primary Examiner*—Bruce M. Kisliuk
*Assistant Examiner*—Eileen P. Morgan
*Attorney, Agent, or Firm*—Jacobson, Price, Holman & Stern

[57] ABSTRACT

A prestressing apparatus for tensioning reinforcement cables in recesses or shafts of structures has a main cylinder-piston unit (15, 17) and a counterforce cylinder-piston unit (16, 22). The two pistons (17, 22) are connected via their piston rods (39, 40) to a fixed arm (2), and the cylinders (15, 16) are connected to a movable arm (10). The main cylinder-piston unit disposed in the middle of the arms and the off-centered counterforce cylinder-piston unit are double-acting. The piston chambers (33, 35, 36, 37) are hydraulically cross-connected. Each side of the counterforce piston has half the piston area of the corresponding communicating side of the main piston, so that the prestressing force (V) and the counterforce (G) are each one-half the pressing force (P). The free ends of the arms extending beyond the main cylinder-piston unit serve to transmit force to the reinforcement

13 Claims, 3 Drawing Sheets

PRESTRESSING APPARATUS

BACKGROUND OF THE INVENTION

This invention relates to the prestressing of concrete, and more particularly to a prestressing apparatus of the type having two cylinder-piston units, the pistons being connected to one another via their piston rods by a first arm, and the cylinders being connected to one another by a second arm.

Prestressing apparatus is used in the building industry for prestressing reinforcement cables or strands of reinforcement cable in recesses or shafts of structures. Prior art trunk-piston prestressing apparatus frequently requires too long a recess or shaft. Furthermore, so-called tandem or twin-piston apparatus having two adjacent cylinder-piston units with parallel axes have been proposed, both the piston rods and cylinders of these units being connected by yokes, and the units being hydraulically connected in parallel. The output of force takes place via the two yokes in the middle axis between the two cylinder-piston units. However, such prestressing apparatus cannot be used for tensioning a large number wires or strands disposed closely side by side. The space required in the width of the recess would be too great with such apparatus.

BRIEF SUMMARY OF THE INVENTION

It is therefore an object of this invention to provide improved prestressing apparatus requiring less recess length than the prior art trunk-piston prestressing apparatus and less recess width than the aforementioned twin-piston apparatus.

To this end, in the prestressing apparatus according to the present invention, of the type initially mentioned, one cylinder-piston unit is formed as a main cylinder-piston unit and the other cylinder-piston unit as a counterforce cylinder-piston unit, the main cylinder-piston unit is disposed in the middle region of the arms and the counterforce cylinder-piston unit in one end region of the arms, and in the other end region the arms extend beyond the main cylinder-piston unit for force transmission.

In the case of shallow recesses, the inventive prestressing apparatus has the advantage that both cylinders are situated above the surface of the structure, so that they can be utilized even for recesses of very short length.

BRIEF DESCRIPTION OF THE DRAWINGS

Preferred embodiments of the invention, as well as their use, will now be described in detail with reference to the accompanying drawings, wherein.

DETAILED DESCRIPTION

Figure 1:
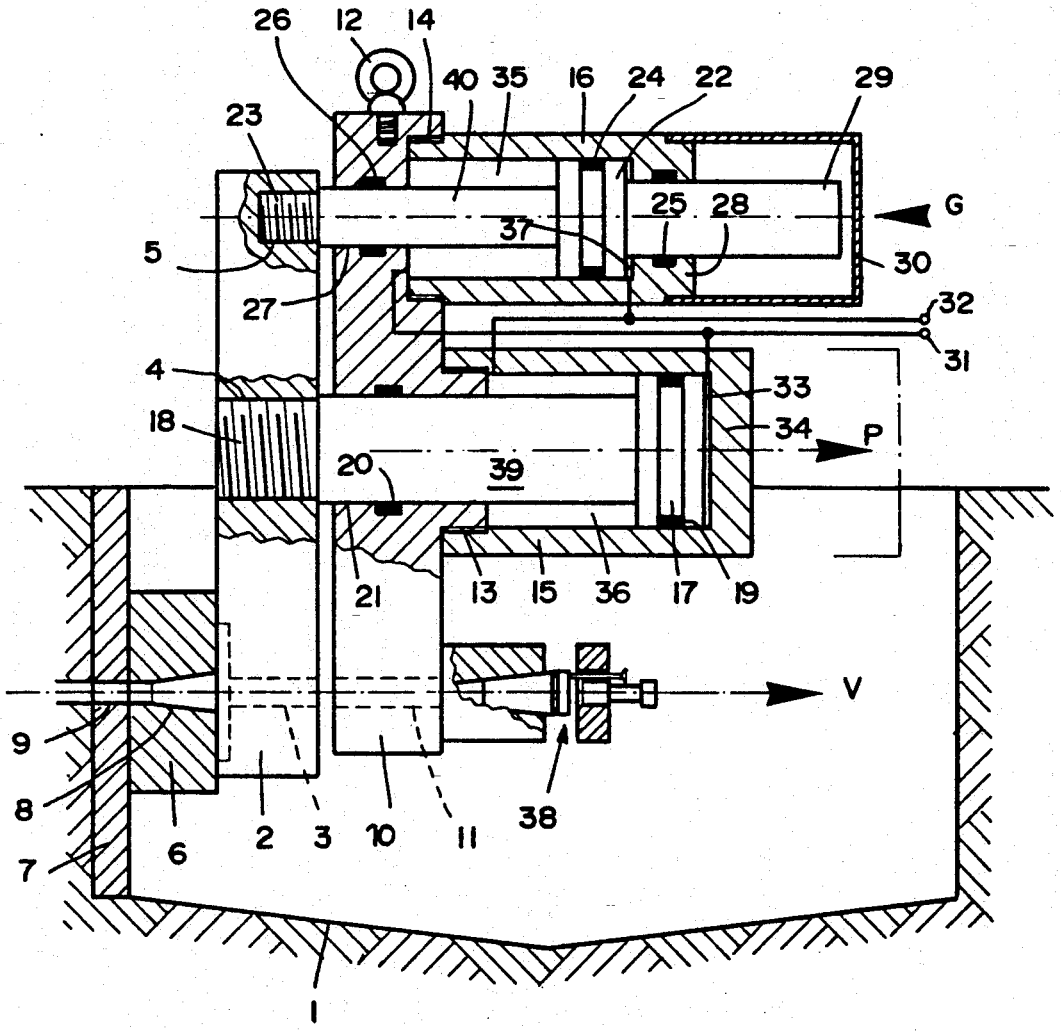
FIG. 1 is a cross-sectional view through a first embodiment of the prestressing apparatus of the invention with non-tensioned reinforcement cable.

The prestressing apparatus being used in a recess 1 comprises a fixed arm 2 having an aperture 3 passing through it for the reinforcement cable to be tensioned and two threaded bores 4 and 5. The lower portion of fixed arm 2 rests in recess 1 against an anchor head 6 joined to an anchor plate 7. Anchor head 6 and anchor plate 7 are likewise provided with apertures 8 and 9 passing through them for the reinforcement cable.

The prestressing apparatus further comprises a movable arm 10 having a bore 11 for the reinforcement cable. Movable arm 10 is suspended from a hoist (not shown) by an eye secured to the top of this arm. On the side remote from fixed arm 2, movable arm 10 has a threaded appendage 13 and a threaded bore 14.

A main cylinder 15 is screwed onto appendage 13, while a counterholding cylinder 16 is screwed into bore 14. A main piston 17, movable relative to main cylinder 15, is provided at one end of its piston rod 39 with a thread 18 and is screwed into bore 4. Main piston 17 is sealed by a packing 19 relative to the cylinder wall and by a packing 20 relative to a bore 21 in which it is guided within movable arm 10. A counterforce piston 22 is likewise provided at one end of its piston rod 40 with a thread 23 which is screwed into bore 5. Counterforce piston 22 is sealed by a packing 24 relative to the inside wall of cylinder 16, by a packing 25 in the front end 28 of that cylinder, and by a packing 26 relative to a bore 27 in which it is guided in movable arm 10.

Counterforce piston 22 is extended beyond front end 28 of cylinder 16 by means of an appendage 29 covered by a closed protective tube 30. A supply line 31 communicates with the space 33 between the end of main piston 17 and the front end 34 of main cylinder 15 and with the space 35 between the piston rod 40 and the inside wall of cylinder 16. A return line 32 communicates with the space 36 between main piston rod 39 and the inside wall of cylinder 15 and with the space 37 between piston 22 and front end 28 of cylinder 16.

The cylinder chambers are therefore cross-connected. During tensioning, hydraulic oil flows through line 31 into space 33 of main cylinder 15, and displaced hydraulic oil from space 35 of cylinder 16 likewise flows into space 33 of main cylinder 15. From space 36, displaced hydraulic oil flows to space 37 of cylinder 16 and into a tank.

During tensioning, fixed arm 2 is braced against the wall of recess 1 via anchor head 6 and anchor plate 7, i.e., fixed arm 2 with main piston 17 and piston 22 remains stationary, whereas movable arm 10 with main cylinder 15 and cylinder 16 connected thereto moves to the right, as viewed in FIG. 1, and brings about the introduction of force into the cable to be tensioned. The cable to be tensioned is connected to movable arm 10 by a clamping unit 38. The force-transmission location at the bottom of legs 2 and 10, off-centered from the cylinder axis of main cylinder-piston unit 15, 17, generates considerable leverage on the prestressing apparatus, the piston rod and guides of which would not be in a position to take it on. The prestressing apparatus is therefore equipped, similarly to the function of the carrying bolt of a parallel screw clamp, with the off-centered counterforce cylinder-piston unit 16, 22 to compensate for the leverage. The counterforce cylinder-piston unit is, for example, disposed at the same distance as the force-transmission location, but on the opposite side of the main cylinder-piston unit, so that in order to equalize the leverage, it will generate a counterforce G of the same magnitude as the prestressing force V transmitted toward the outside, but which is directed opposite to the direction of the pressing force P of the main cylinder-piston unit. Both the main cylinder-piston unit and the cylinder-piston unit are double-acting. In addition, the cylinder-piston unit is designed as a differential cylinder-piston unit, each side of piston 22 having half the piston area of the corresponding communicating side of main piston 17. Both during the tensioning movement and during the return movement, the same ratio of piston area between the main piston and the counterforce piston is produced each time. Force G exerted by the counterforce cylinder-piston unit therefore corresponds to half the force of the main cylinder-piston unit at the same oil pressure, both during tensioning and during the return movement. If, for example, pressing force P=500 kN, counterforce force G and tensioning force V are each 250 kN.

Figure 2:
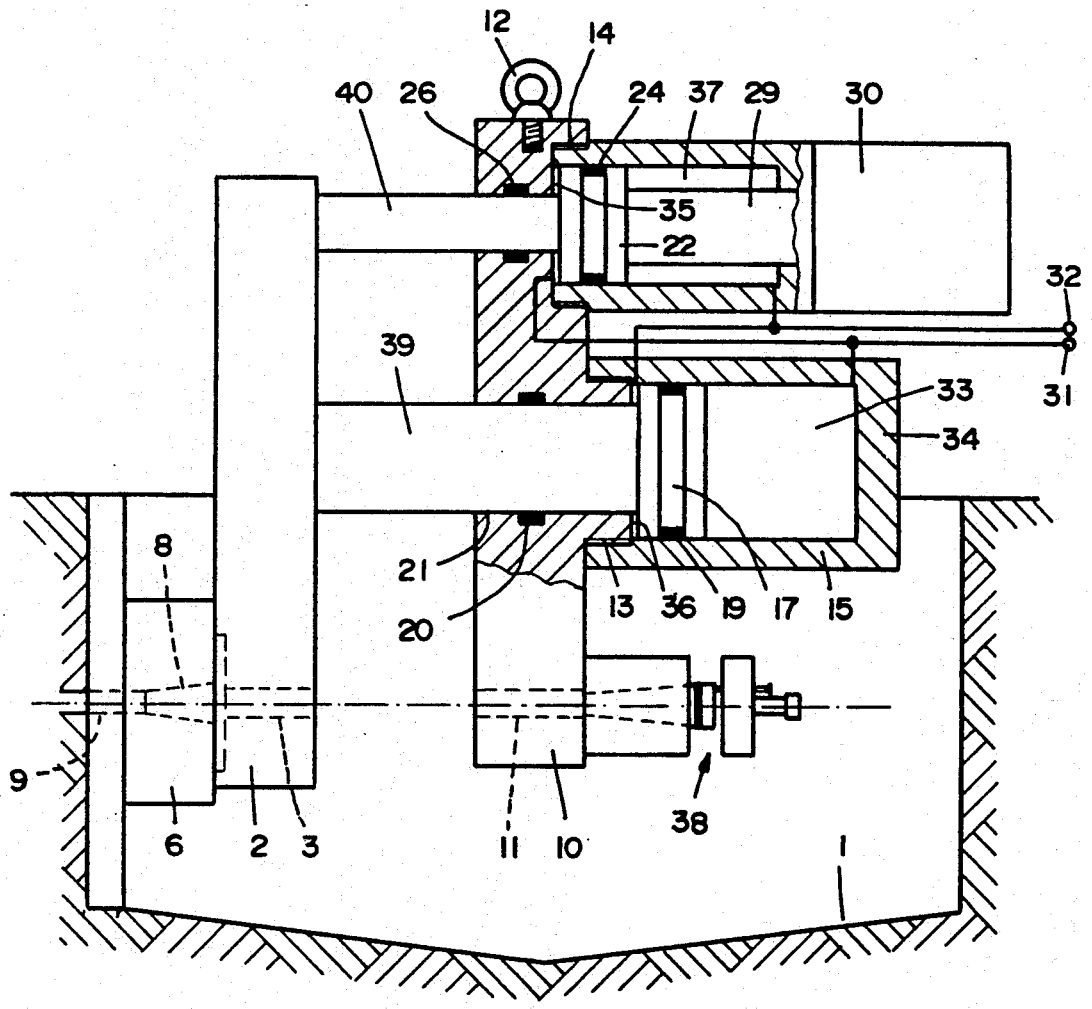
FIG. 2 is an elevational view, partly in cross-section, of the prestressing apparatus of FIG. 1, with tensioned reinforcement cable.

In FIG. 2, the prestressing apparatus is shown in the tensioned state. As compared with trunk-piston prestressing apparatus, the axial space requirement in recess 1 of the structure is less for the inventive prestressing apparatus. The recess length, for example, is only 55 cm instead of 75 cm. As compared with a prior art tandem or twin-piston prestressing apparatus having two adjacent cylinders with parallel axes, the space requirement for the inventive prestressing apparatus in the width of the recess (perpendicular to the drawing plane of FIGS. 1 and 2) is less. After tensioning has taken place, the tensioned reinforcement cable is permanently anchored in anchor head 6.

When the apparatus moves in the opposite direction, i.e., during the return from the position of FIG. 2 to the position of FIG. 1, hydraulic oil flows through line 32 into space 36 of main cylinder 15 and from space 37 of cylinder 16 likewise into space 36 of main cylinder 15, while hydraulic oil from space 33 of main cylinder 15 flows into space 35 of cylinder 16 and into the tank.

Figure 3:
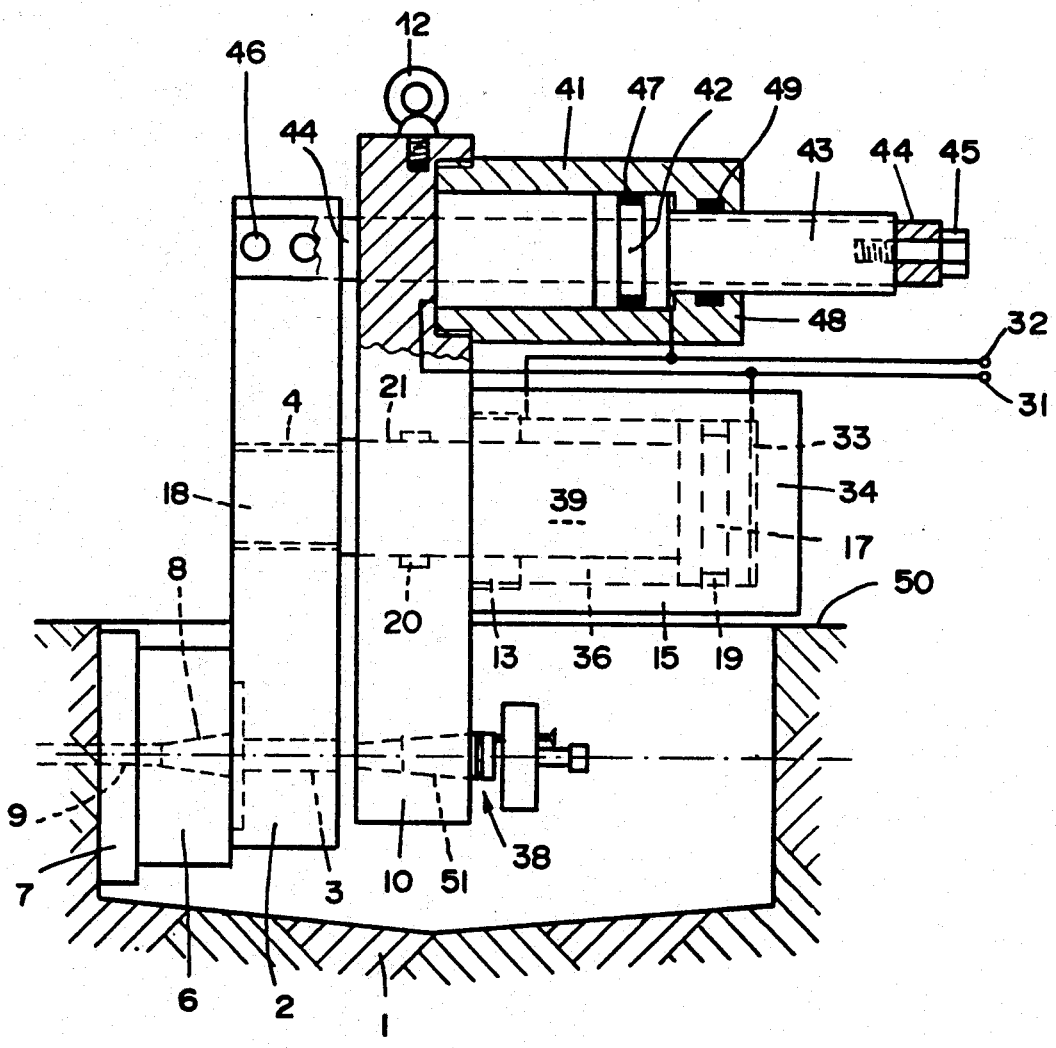
FIG. 3 is an elevational view, partly in cross-section, of another embodiment of the prestressing apparatus, also partly in section, with non-tensioned reinforcement cable.

Another embodiment of the invention is illustrated in FIG. 3. Identical parts are designated by the same reference numerals as used for the embodiment of FIGS. 1 and 2. A difference as compared with the first embodiment relates to the counterforce cylinder-piston unit. Instead of a differential cylinder-piston unit, a normal double-acting cylinder-piston unit is provided, although it performs the same function as the differential cylinder-piston unit. A piston 42 guided in a cylinder 41 is connected via a piston rod 43 and a shackle 44 to fixed arm 2. Shackle 44 is secured to piston rod 43 and to arm 2 by means of screws 45 and 46. A packing 47 is disposed in piston 42 and a packing in the front end 48 of cylinder 41. In the case of the shallow recess 1 shown in FIG. 3, main cylinder 15 moves above the surface 50 of the structure. This presents the advantage that even recesses of very short length can be used. Such use is additionally made possible by incorporating clamping unit 38 with its conical portion 51 in the bottom of movable arm 10.

As a modification, a simplified operating hydraulic system would also be conceivable, in which chamber 36 of main cylinder 17 would contain a spring, and the counterforce cylinder would merely have chamber 35.

The prestressing apparatus might also be used to hoist loads, in which case the fixed arm would be placed on the ground and the movable arm pushed under the load to be lifted.

I claim:

1. A prestressing apparatus comprising:

a first arm having a substantially central region and end regions spaced outwardly and substantially oppositely from said central region of said first arm, one of said end regions being adapted for applying a compressive force against a member to be prestressed;

a second arm having a substantially central region and end regions spaced outwardly and substantially oppositely from said central region of said second arm, one end region of said second arm being adapted for applying a force to a load member in a direction away from said first arm and outwardly of said member to be prestressed;

a main double-acting cylinder-piston unit comprising a main cylinder connected to said second arm proximate said central region thereof, a main piston mounted in said main cylinder for reciprocating movement therein, and a main piston rod connected to said main piston and extending in sliding engagement through said central region of said second arm and connected to said first arm proximate said central region of said first arm; and a double-acting counterforce cylinder-piston unit comprising a counterforce cylinder connected to said second arm proximate another end region of said second arm, a counterforce piston mounted in said counterforce cylinder for reciprocating movement therein, and a counterforce piston rod connected to said counterforce piston and extending in sliding engagement through said other end region of said second arm and connected to another end region of said first arm, so that said cylinders are interconnected by said second arm and said piston rods are interconnected by said first arm, and pressure applied to said main cylinder-piston unit in one direction moves said second arm away from said first arm to apply a main force on a load member engaged with said one end region of said second arm and simultaneous pressure in said counterforce cylinder-piston unit for producing a force on said other end region of said second arm substantially opposite to said main force produced on said one end region of said second arm.

2. The prestressing apparatus as claim in claim 1, wherein:

said counterforce cylinder-piston unit comprises a differential cylinder-piston unit wherein said main piston and said counterforce piston have the same piston-area ration during movement of said second arm in the direction to apply said main force and in the return direction.

3. The prestressing apparatus as claimed in claim 1 and further comprising;

at least one first bore in said one of said end regions of said first arm for receiving therethrough a prestressing load member;

at least one second bore in said one of said end regions of said second arm coaxial with said at least one first bore in said first arm for receiving therethrough said prestressing member; and means for engaging said prestressing load member with said second arm for tensioning said prestressing load member upon operation of said prestressing apparatus to move said second arm away from said first arm.

4. The prestressing apparatus as claim in claim 1, wherein:

aligned bores are provided in said one of said end regions of said first end second arms; and said load member comprises a reinforcing cable extending through said aligned bores.

5. A prestressing apparatus comprising:

a first arm having a substantially central region and end regions spaced outwardly and substantially oppositely from said central region of said first arm, one of said end regions being adapted for applying a compressive force against a member to be prestressed;

a second arm having a substantially central region and end regions spaced outwardly and substantially oppositely from said central region of said second arm, one end region of said second arm being adapted for applying a force to a load member in a direction away from said first arm and outwardly of said member to be prestressed;

a main piston unit comprising a main cylinder connected to said second arm proximate said central region thereof, a main piston mounted in said main cylinder for reciprocating movement therein, and a main piston rod connected to said main piston and extending in sliding engagement through said central region of said second arm and connected to said first arm proximate said central region of said first arm; and a counterforce cylinder-piston unit comprising a counterforce cylinder connected to said second arm proximate another end region of said second arm, a counterforce piston mounted in said counterforce cylinder for reciprocating movement therein, and a counterforce piston rod connected to said counterforce piston and extending in sliding engagement through said other end region of said second arm and connected to another end region of said first arm, so that said cylinders are interconnected by said second arm and said piston rods are interconnected by said first arm, and pressure applied to said main cylinder-piston unit in one direction moves said second arm away from said first arm to apply a main force on a load member engaged with said one end region of said second arm and simultaneous pressure in said counterforce cylinder-piston unit for producing a force on said other end region of said second arm substantially opposite to said main force produced on said one end region of said second arm; and hydraulic means interconnecting said main cylinder and said counterforce cylinder so that hydraulic pressure applied to said main cylinder in said one direction to produce said main force on said load member produces a force on said counterforce piston in said one direction, and hydraulic pressure applied to said main cylinder in a direction opposite to said one direction applies a return force to said second arm for releasing said main force on said load member and applies a pressure on said counterforce piston in a direction opposite to said one direction and a force on said second arm in said one direction.

6. The prestressing apparatus as claimed in claim 5 wherein:

said cylinder-piston units comprise double-acting cylinder-piston units.

7. The prestressing apparatus as claimed in claim 6 wherein:

said counterforce cylinder-piston unit comprises a differential cylinder-piston unit wherein said main piston and said counterforce piston have the same piston-area ration during movement of said second arm in the direction to apply said main force and in the return direction.

8. The prestressing apparatus as claimed in claim 7 and further comprising;

at least one first bore in said one of said end regions of said first arm for receiving therethrough a prestressing load member;

at least one second bore in said one of said end regions of said second arm coaxial with said at least one first bore in said first arm for receiving therethrough said prestressing member; and means for engaging said prestressing load member with said second arm for tensioning said prestressing load member upon operation of said prestressing apparatus to move said second arm away from said first arm.

9. The prestressing apparatus as claimed in claim 5 wherein:

said counterforce cylinder-piston unit comprises a differential cylinder-piston unit wherein said main piston and said counterforce piston have the same piston-area ration during movement of said second arm in the direction to apply said main force and in the return direction.

10. The prestressing apparatus as claimed in claim 9 and further comprising:

at least one first bore in said one of said end regions of said first arm for receiving therethrough a prestressing load member;

at least one second bore in said one of said end regions of said second arm coaxial with said at least one first bore in said first arm for receiving therethrough said prestressing member; and means for engaging said prestressing load member with said second arm for tensioning said prestressing load member upon operation of said prestressing apparatus to move said second arm away from said first arm.

11. A prestressing apparatus comprising:

a first arm having a substantially central region and end regions spaced outwardly and substantially oppositely from said central region of said first arm, one of said end regions being adapted for applying a compressive force against a member to be prestressed;

a second arm having a substantially central region and end regions spaced outwardly and substantially oppositely from said central region of said second arm, one end region of said second arm being adapted for applying a force to a load member in a direction away from said first arm and outwardly of said member to be prestressed;

a main cylinder-piston unit comprising a main cylinder connected to said second arm proximate said central region thereof, a main piston mounted in said main cylinder for reciprocating movement therein, and a main piston rod connected to said main piston and extending in sliding engagement through said central region of said second arm and connected to said first arm proximate said central region of said first arm; and a counterforce cylinder-piston unit comprising a counterforce cylinder connected to said arm proximate another end region of said second arm, a counterforce piston mounted in said counterforce cylinder for reciprocating movement therein, and a counterforce piston rod connected to said counterforce piston and extending in sliding engagement through another end region of said second arm and connected to another end region of said first arm, so that said cylinders are interconnected by said second arm and said piston rods are interconnected by said first arm, and pressure applied to said main cylinder-piston unit in one direction moves said second arm away from said first arm to apply a main force on a load member engaged with said one end region of said second arm and simultaneous pressure in said counterforce cylinder-piston unit for producing a force on said other end region of said second arm substantially opposite to said main force produced on said one end region of said second arm;

said counterforce cylinder-piston unit comprising a differential cylinder-piston unit wherein said main piston and said counterforce piston have the same piston-area ration during movement of said second arm in the direction to apply said main force and in the return direction.

12. The prestressing apparatus as claim in claim 11 wherein:

said cylinder-piston units comprise double-acting cylinder-piston units.

13. A prestressing apparatus comprising:

a first arm having a substantially central region and end regions spaced outwardly and substantially oppositely from said central region of said first arm, one of said end regions being adapted for applying a compressive force against a member to be prestressed;

a second arm having a substantially central region and end regions spaced outwardly and substantially oppositely from said central region of said second arm, one end region of said second arm being adapted for applying a force to a load member in a direction away from said first arm and outwardly of said member to be prestressed;

a main double-acting cylinder-piston unit comprising a main cylinder connected to said second arm proximate said central region thereof, a main piston mounted in said main cylinder for reciprocating movement therein, and a main piston rod connected to said main piston and extending in sliding engagement through said central region of said second arm and connected to said first arm proximate said central region of said first arm; and a double-acting counterforce cylinder-piston unit comprising a counterforce cylinder having one end connected to said second arm proximate another end of second arm, an outer end on said counterforce cylinder remote from said second arm, a counterforce piston mounted in said counterforce cylinder for reciprocating movement therein, and a counterforce piston rod connected to said counterforce piston and extending in sliding engagement through said outer end of said counterforce cylinder and having an outer end, a shackle having one end connected to said other end region of said first arm and an outer end connected to said outer end of said counterforce piston, so that said cylinders are interconnected by said second arm and said piston rods are interconnected by said first arm, and pressure applied to said main cylinder-piston unit in one direction moves said second arm away from said first arm to apply a main force on a load member engaged with said one end region of said second arm and simultaneous pressure in said counterforce cylinder-piston unit for producing a force on said other region end of said second arm substantially opposite to said main force produced on said one end region of said second arm.

* * * * *